US006869082B2

(12) United States Patent
Parker

(10) Patent No.: US 6,869,082 B2
(45) Date of Patent: Mar. 22, 2005

(54) TURBINE SPRING CLIP SEAL

(75) Inventor: David M. Parker, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/460,128

(22) Filed: Jun. 12, 2003

(65) Prior Publication Data

US 2004/0251639 A1 Dec. 16, 2004

(51) Int. Cl.[7] ..... F16J 15/02
(52) U.S. Cl. ..... 277/630; 277/637; 277/641
(58) Field of Search ..... 277/630, 637, 277/641

(56) References Cited

U.S. PATENT DOCUMENTS

| | | | | |
|---|---|---|---|---|
| 3,759,038 | A | 9/1973 | Scalzo et al. | |
| 3,807,195 | A | 4/1974 | Faulbecker | |
| 3,869,222 | A * | 3/1975 | Rahnk et al. | 415/134 |
| 3,938,906 | A | 2/1976 | Michel et al. | |
| 4,184,689 | A | 1/1980 | Brodell et al. | |
| 4,314,793 | A | 2/1982 | DeTolla et al. | |
| 4,376,542 | A | 3/1983 | Hennessy | |
| 4,645,217 | A * | 2/1987 | Honeycutt et al. | 277/555 |
| 4,785,623 | A | 11/1988 | Reynolds | |
| 5,118,120 | A | 6/1992 | Drerup et al. | |
| 5,143,292 | A * | 9/1992 | Corsmeier et al. | 239/127.3 |
| 5,400,586 | A | 3/1995 | Bagepalli et al. | |
| 5,797,723 | A | 8/1998 | Frost et al. | |
| 5,987,879 | A | 11/1999 | Ono | |
| 6,076,835 | A | 6/2000 | Ress et al. | |
| 6,164,656 | A | 12/2000 | Frost | |
| 6,402,466 | B1 | 6/2002 | Burdgick et al. | |
| 6,464,232 | B1 * | 10/2002 | Marchi et al. | 277/630 |
| 6,464,457 | B1 * | 10/2002 | Morgan et al. | 415/174.2 |

* cited by examiner

*Primary Examiner*—Alison Pickard
*Assistant Examiner*—Enoch E Epavey

(57) ABSTRACT

An improved turbine spring clip seal for directing gases to be mixed with fuel in a combustor basket. The turbine clip seal may include an inner housing and an outer housing. The inner housing or the outer housing, or both, may include one or more tapered leaves forming a portion of the spring clip seal. At least one leaf may include a flared end for limiting gas from passing through the slots in the spring clip seal. In at least one embodiment, the turbine clip seal may include a center sealing member positioned between the inner and outer housings.

20 Claims, 7 Drawing Sheets

TURBINE SPRING CLIP SEAL

FIELD OF THE INVENTION

The present invention relates in general to sealing systems and, more particularly, to an improved turbine spring clip seal for directing gases to mix with fuel in a combustor basket in a turbine engine.

BACKGROUND OF THE INVENTION

There exists a plethora of variables that affect performance of a turbine engine. One such variable that has been identified in dry-low NOx (DLN) combustor design turbines is the air flow distribution between the combustor zone and the leakage air flows. Typically, a spring clip seal is used in such a turbine engine to direct gases, such as common air, into a combustor basket where the air mixes with fuel. Conventional spring clip seals direct air through center apertures in the seals and are formed from outer and inner housings. The seals are generally cylindrical cones that taper from a first diameter to a second, smaller diameter. The first diameter is often placed in contact with a transition inlet ring, and the second, smaller diameter is often fixedly attached to a combustor basket. The inner and outer housings include a plurality of slots around the perimeter of the housings which form leaves in the housing. The leaves are capable of flexing and thereby imparting spring properties to the spring clip seal. This spring force assists in at least partially sealing the inner housing to the outer housing.

Conventional spring clips allow up to 8% of the total air flow distribution flowing through a center aperture of a spring clip seal to leak through the seal. Such leakage can often cause undesirable outcomes. For instance, air leakage at this level can cause high engine performance variability, which is characterized by high NOx emissions, high dynamics or flashback, or any combination thereof.

Turbine spring clip seals have attempted to reduce leakage across the seal by configuring the inner housing and the outer housing, each having a plurality of slots, so that the slots in the inner housing are offset relative to the slots in an outer housing, thereby reducing leakage across the seal. However, the number of slots contained in conventional seals limits the ability of the seals to prevent air leakage.

Therefore, there exists a need for an improved turbine spring clip seal that reduces the amount of air leaking through slots in the seal.

SUMMARY OF THE INVENTION

Set forth below is a brief summary of the invention that solves the foregoing problems and provides benefits and advantages in accordance with the purposes of the present invention as embodied and broadly described herein. This invention is directed to a turbine spring clip seal having reduced stresses and loads during operation and use for sealing openings between adjacent turbine components and directing air through a center aperture in the seal. The turbine spring clip seal of the invention is generally composed of an outer housing and an inner housing. The outer and inner housings each includes a coupler section and a transition section. The coupler section of the outer housing is configured to be fixedly attached to a first turbine component, and the transition section of the outer housing extends from the coupler section at a first end of the transition section. The transition section is also adapted to maintain contact between a second end of the transition section and a second turbine component during operation of a turbine. The transition section tapers from a first diameter at the first end of the transition section to a second diameter, which is larger than the first diameter, at the second end of the transition section.

The inner housing also has a coupler section and a transition section that may be shaped similarly to the outer housing but sized to nest within the outer housing. The inner coupler section of the inner housing is adapted to be fixedly attached to the outer coupler section of the outer housing. The inner transition extends from the inner coupler section at a first end of the inner transition section. The inner transition section continues to a second end of the transition section and secures to the outer housing during operation of the turbine. The inner housing is configured to fit inside the outer housing and, in one embodiment, tapers from a third diameter at the first end of the transition section to a fourth diameter, which is larger than the third diameter, at the second end of the inner transition section.

According to the invention, the inner or outer housing, or both, may be formed from two or more leaves defined by slots separating the leaves. One or more leaves may be tapered from ends of the leaves connected to the inner and outer coupler sections, respectively, to the free ends of the housings. Tapering the leaves reduces the stresses and loads imparted by a turbine engine on the inner and outer housing during operation of the turbine engine in which the spring clip seal may be mounted.

One or more of the leaves of the inner or outer housings, or both, may include a flared end for providing a larger sealing surface by which the spring clip seal may be attach to a combustor basket of a turbine engine. In at least one embodiment, each leaf has a flared end. The width of the flared end may be substantially equal to the width of the leaf at a first end of the leaf coupled to the inner or outer coupler section of the inner or outer housings, respectively. In other embodiments, a flared end may be wider than a minimum width of a leaf at a point on the leaf between the flared and the first end connected to the inner or outer coupler section, respectively.

In another embodiment, the spring clip seal may include a center sealing member positioned between the inner housing and the outer housing and may be configured to prevent a fluid from passing therebetween. In one embodiment, the center sealing member includes a plurality of leaves formed by slots. The inner and outer housings may also include slots forming leaves between adjacent slots. The center sealing member may be positioned relative to the outer housing so that the leaves of the center sealing member align with the slots of the outer housing, thereby preventing a fluid from passing through the outer housing slots. The center sealing member may also be aligned so that its leaves are aligned with slots in the inner housing, or alternatively, the leaves of the center sealing member may also be aligned with the slots of the inner housing in addition to the slots of the outer housing.

An object of this invention includes, but is not limited to, increasing the efficiency of a turbine engine by preventing a fluid, such as common air, from leaking between an inner housing and an outer housing of a seal while the fluid is directed to pass through a center aperture in the seal.

An advantage of this invention is that the turbine spring clip seal reduces leakage, and may stop leakage, between an inner housing and an outer housing of the spring clip seal.

Another advantage of this invention is that this turbine spring clip seal experiences reduced levels of stress and load during operation of a turbine engine in which the turbine spring clip seal may be mounted. Each leaf of the turbine spring clip seal experiences reduced stress levels. Thus, the turbine spring clip seal may be formed from reduced numbers of leaves, which in turn reduces the number of slots through which air may pass. The reduction in the number of leaves of the spring clip relative to conventional spring clips reduces the leakage of air through the turbine spring clip.

These and other advantages and objects will become apparent upon review of the detailed description of the invention set forth below.

DETAILED DESCRIPTION OF THE INVENTION

Figure 2:
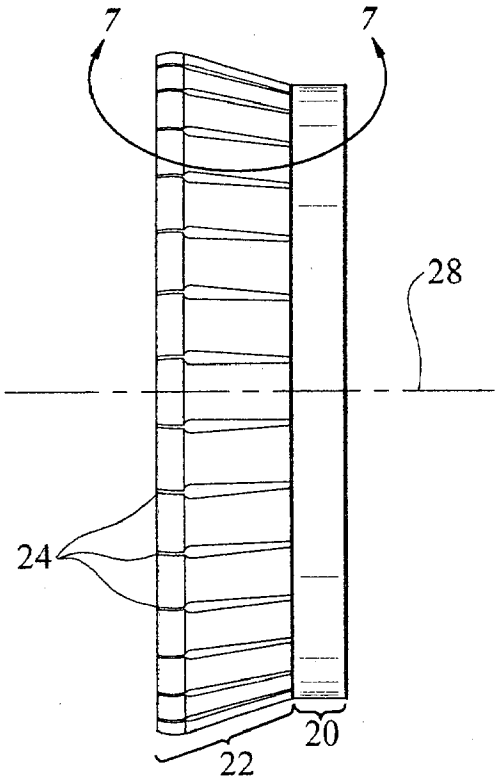
FIG. 2 is a right side view of the turbine spring clip seal of FIG. 1.
Figure 1:
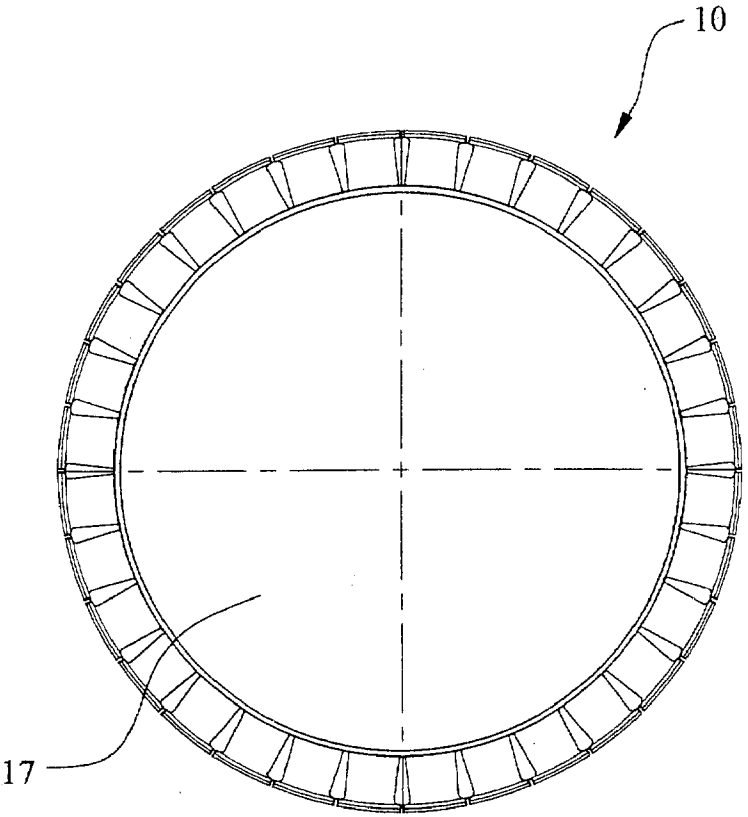
FIG. 1 is a front view of a turbine spring clip seal composed of an outer housing and an inner housing viewed so that the inner housing is visible.

Referring to FIGS. 1 and 2, a turbine spring clip seal 10 can be configured as a generally cylindrical- or ring-shaped assembly, including an outer housing 16 and an inner housing 14. A turbine spring clip seal 10, such as one according to the invention, is usable in turbine engines to direct gases to mix with fuel flowing into a conventional combustor basket 12 (see FIG. 10). The spring clip seal is intended to direct fluid flow and to prevent at least a portion of air directed through the center aperture 17 in the turbine spring seal from leaking between the inner and outer housings 14 and 16. The flow region within the center aperture 17 is relatively lower in pressure than the region outside housing 14, so that fluid leakage generally occurs from the outside in. In an alternative embodiment of this invention, the turbine spring clip seal 10 may include a center sealing member 66.

Figure 3:
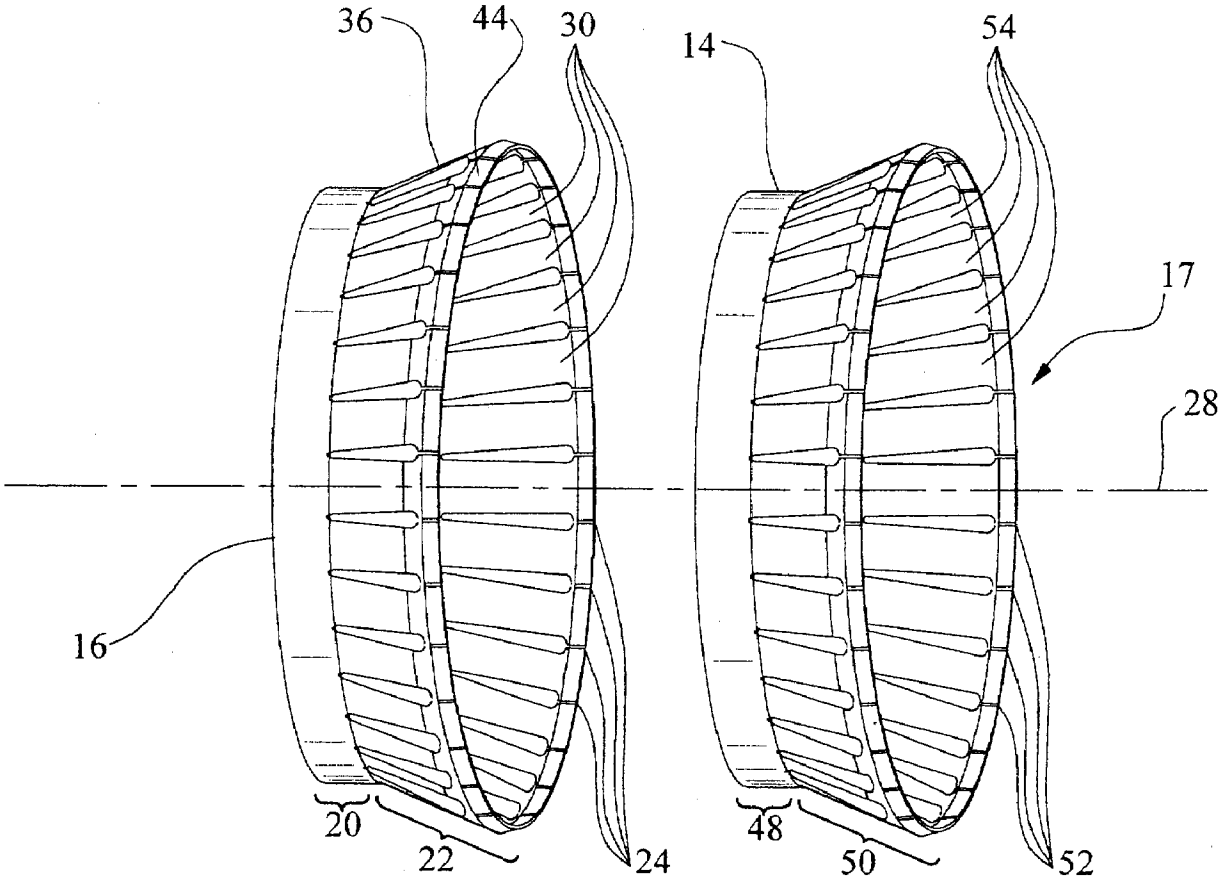
FIG. 3 is an exploded side view of the turbine spring clip seal of FIG. 1.
Figure 7:
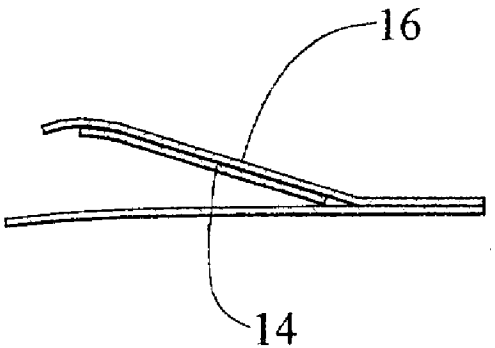
FIG. 7 is a right side view of the turbine spring clip seal taken at detail 7—7 in FIG. 2.

As shown in FIGS. 1–5, the turbine spring clip seal 10 may be formed from an outer housing 16 and an inner housing 14. The inner housing 14 may be configured to nest in outer housing 16, as shown in FIG. 7. The outer housing 16, as shown in FIG. 3, may be formed from an outer coupler section 20 and an outer transition section 22 extending therefrom. In one embodiment, the outer housing 16 may have a configuration resembling a conventional reducer and have a generally conical shape, although alternative geometries are considered within the scope of the invention. The outer coupler section 20 may be in the shape of a ring and is configured to be fixedly attached to a turbine component using for instance, a weld bond. In one embodiment, the outer coupler section 20 may be fixedly attached to a combustor basket 12 (see FIG. 10). In one embodiment, the outer transition section 22 has a general conical shape.

The outer housing 16 also may include a plurality of slots 24 that are typically located in the outer transition section 22. The slots 24 preferably extend from an edge of the outer transition section 22 into the outer transition section 22 toward the outer coupler section 20. The slots 24 may have any length, and in one embodiment, one or more of the slots 24 may extend to the outer coupler section 20. In yet another embodiment, the slots 24 may extend through the width of the outer transition section 22 and into the coupler section 20. However, the slots 24 should not extend completely through the coupler section 20.

The plurality of slots 24 may be composed of two or more slots and, in one embodiment, the number of the slots 24 may range between about twenty slots and about thirty-two slots. The slots 24 are positioned generally parallel to a longitudinal axis 28 of the turbine spring clip seal 10 and the outer housing 16 and form leaves 30 between adjacent slots 24. The leaves 30 are flexible and are capable of deflecting inwardly.

Figure 6:
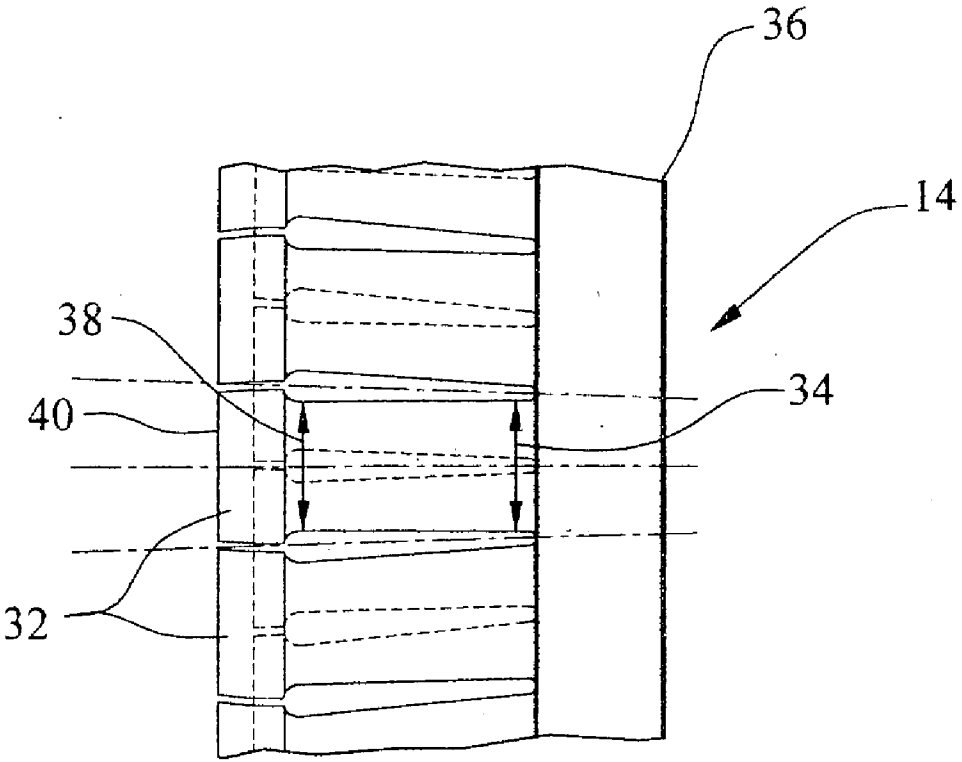
FIG. 6 is a detailed view of the turbine spring clip seal taken at detail 6—6 in FIG. 5.

As shown in FIG. 6, one or more leaves 30 may taper in width from the end of the leaf 30 connected to the outer coupler section 20 to the opposite end of the leaf 30. In particular, the leaf 30 may taper from a first dimension 34 at a first end 36 of the outer transition section 22 to a second dimension 38 at a second end 40 of the outer transition section 22. In at least one embodiment, the second dimension 38 is less than the first dimension 34. Depending on the amount of taper, the tapered shape of the leaves 30 may reduce the section modulus at the second end 40 to about 50 percent less than the section modulus at the first end 36. This may reduce the stresses and load experienced by the outer housing 16 by about 40 percent in some embodiments. Reduction in stress in a leaf 30 of the outer housing 24 may permit the total number of leaves 30 forming the outer housing 16 to be reduced as compared with conventional spring clip seals. By reducing the number of slots 24 found in the outer housing 16, the amount of leakage of air through the slots 24 may be reduced. For instance, a 20 percent reduction in the number of slots 24 may result in about a 20 percent reduction in leakage of air through the slots 24.

One or more leaves 30 may include a flared end 32. In at least one embodiment, each leaf 30 forming the outer transition section 22 may include a flared end 32. The width of the flared end 32 may be substantially equal to or greater than the width of the leaf 30 where the leaf 30 extends from the outer coupler section 20. In other embodiments, the width of the flared end 32 may be at least greater than the width of the leaf between the flared end 32 and the outer coupler section 20. The width of the flared end 32 may be greater than the second dimension 38. The flared ends 32 increase the ability of the spring clip seal 10 to form a seal with a combustor basket, as shown in FIG. 10.

Figure 9:
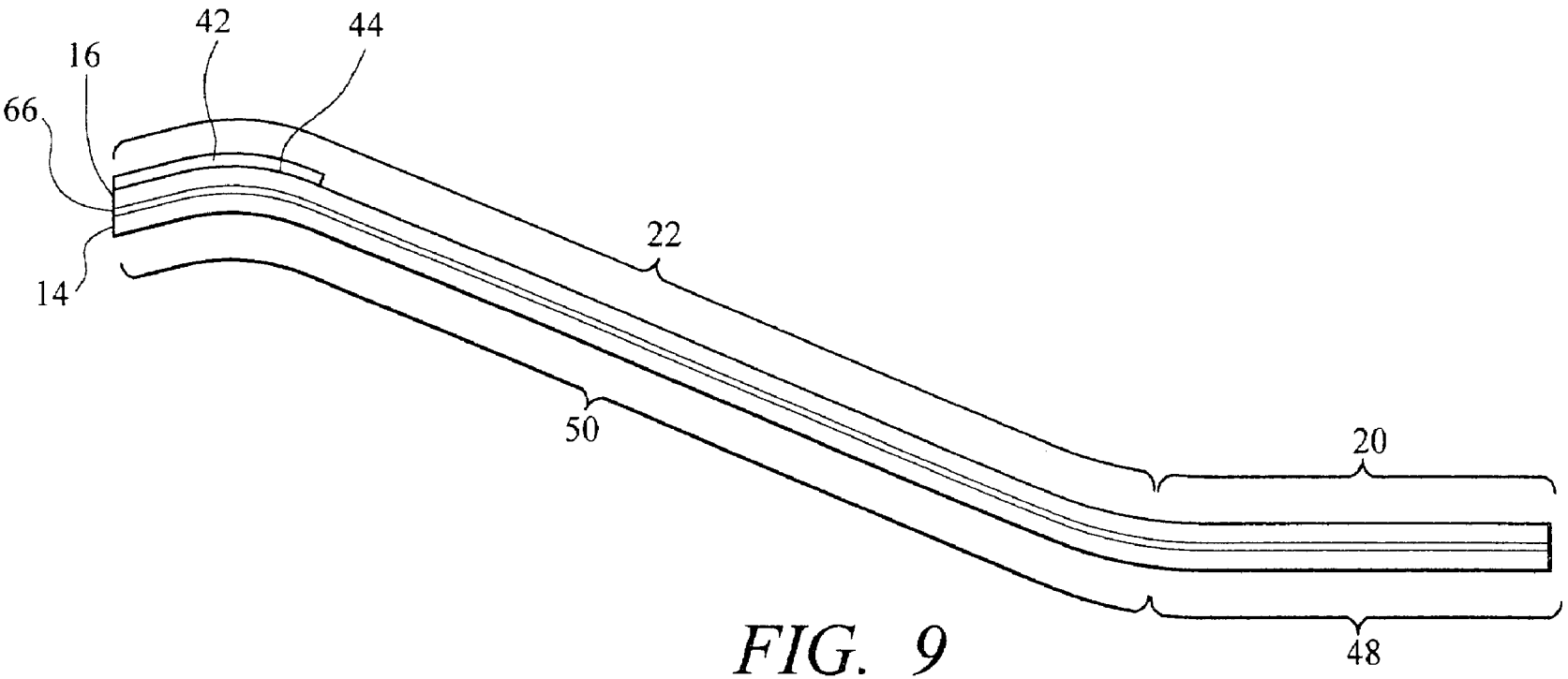
FIG. 9 is a cross-sectional side view of the center sealing member positioned between the inner and outer housings of the embodiment shown in FIG. 8.

The outer housing 16 may also include a wear resistant material 42, as shown in FIG. 9, for reinforcing the turbine spring clip seal 10 at its juncture with a turbine component 46. The wear resistant material 42 may be applied to the outer surface 44 of the outer housing 16 in any location that the outer housing 16 contacts a turbine component 34. In one embodiment, the wear resistant material 42 is applied to the outer surface 44 of the outer housing 16 proximate to the edge of the outer transition section 22 and extending about one inch toward the outer coupler section 20. If the outer housing 16 includes slots 24, the wear resistant material 42 is located on the leaves 30 formed by the slots 24.

In one embodiment, the wear resistant material 42 is composed of chromium carbide and is spray applied. However, the wear resistant material 42 and the method of application are not limited to this material or method. Rather, the wear resistant material 42 may consist of other materials capable of withstanding the hot environment of a turbine engine and may be applied using application methods such as, but not limited to, dipping, anodizing, and other methods.

Figure 10:
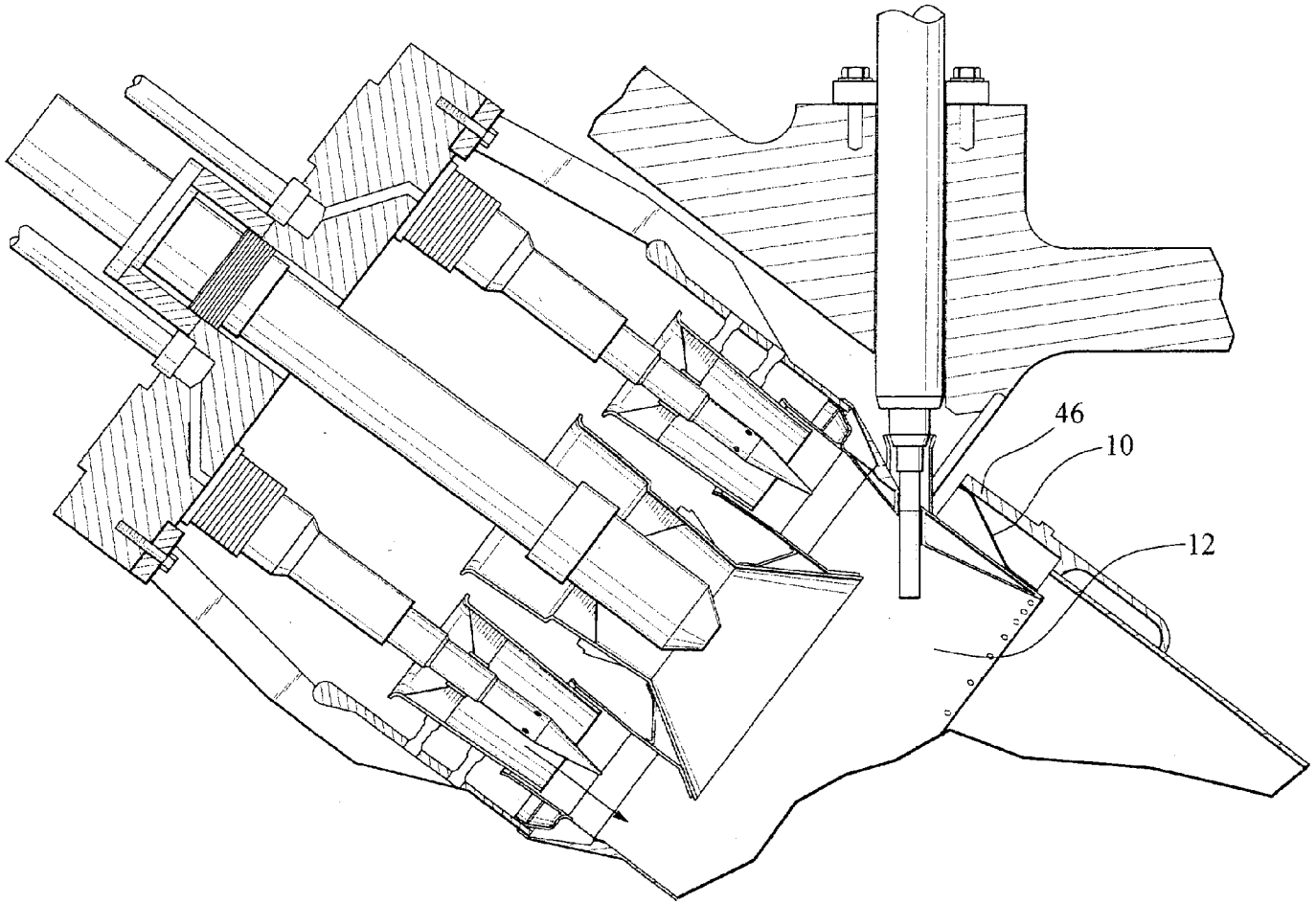
FIG. 10 is a partial cross-section of turbine engine showing the turbine spring clip seal of FIG. 1 installed between a transition inlet ring and a combustor basket.

Typically, the outside diameter of the outer housing 16 is slightly greater than the inside diameter of the turbine component 46 in which the turbine spring clip seal 10 is positioned (see FIG. 10). Such a configuration forms an interference fit with the turbine component 46 and is useful to form an airtight seal. In one embodiment, the turbine component 46 is a transition inlet ring.

Referring again to FIGS. 1–5, the inner housing 14 may be substantially similar in configuration to the outer housing 16, and the inner housing 14 may include all of the elements discussed above, except for the wear resistant material 42. For example, the inner housing 14 may include an inner coupler section 48 and an inner transition section 50 extending therefrom. The inner transition section 50 may include a plurality of slots 52, numbering two or more, that may be generally parallel to the longitudinal axis 28 of the turbine spring clip seal 10 and the inner housing 14. The number of slots 52 may be equal to the number of the slots 24 in the outer housing 16. The inner coupler section 48 of the inner housing 14 may be configured to be attached to the outer coupler section 20 of the outer housing 16, and the inner housing 14 may be configured to fit inside the outer housing 16.

The inner transition section 50 may be formed from two or more leaves 54. One or more of the leaves 54 may include a flared end 56 that may be similar to the leaves 30 of the outer transition section 22. One or more leaves 54 may taper in width from the end of the leaf 54 connected to the inner coupler section 48 to the opposite free end of the leaf 54 forming at least a portion of the inner transition section 50. In particular, the leaf 54 may taper from a first dimension 58 at a first end 60 of the inner transition section 50 to a second dimension 62 at a second end 64 of the inner transition section 50. In at least one embodiment, the second dimension 62 is less than the first dimension 58. The width of the flared end 56 may be greater than the second dimension 64. The taper of the leaves 54 may reduce the stresses and load experienced by the inner housing 14 by about 40 percent in some embodiments. Reduction in stress in the leaf 54 of the inner housing 14 may permit the total number of leaves 54 forming the inner housing 14 to be reduced as compared with conventional spring clip seals. By reducing the number of slots 52 found in the inner housing 14, the amount of leakage of air through the slots 52 may be reduced. For instance, a 20 percent reduction in the number of slots 52 may result in about a 20 percent reduction in leakage of air through the slots 52.

In at least one embodiment, a flared end 56 may be included on each end of the leaves 54 forming the inner transition section 50. The width of the flared end 56 may be substantially equal to the width of the leaf 54 where the leaf 54 extends from the inner coupler section 48. In other embodiments, the width of the flared end 56 may be at least greater than a minimum width of the leaf 54 between the flared end 56 and the inner coupler section 48.

The inner and outer housing 14 and 16 may be formed from any high strength and high temperature material, such as, but not limited to, X750 or a nickel based material. The inner and outer housings 14 and 16 may each have a thickness of about 0.050 of an inch. However, the thickness of the inner and outer housings 14 and 16 are not limited to this thickness. Rather, the thickness may vary depending on the material used in order to maintain the flexibility of the turbine spring clip seal 10.

Figure 5:
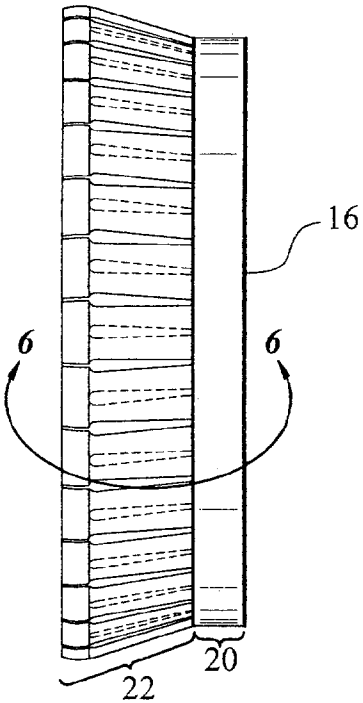
FIG. 5 is a side view of the turbine clip seal of FIG. 4, wherein the slots in the inner housing are misaligned with the slots in the outer housing.
Figure 4:
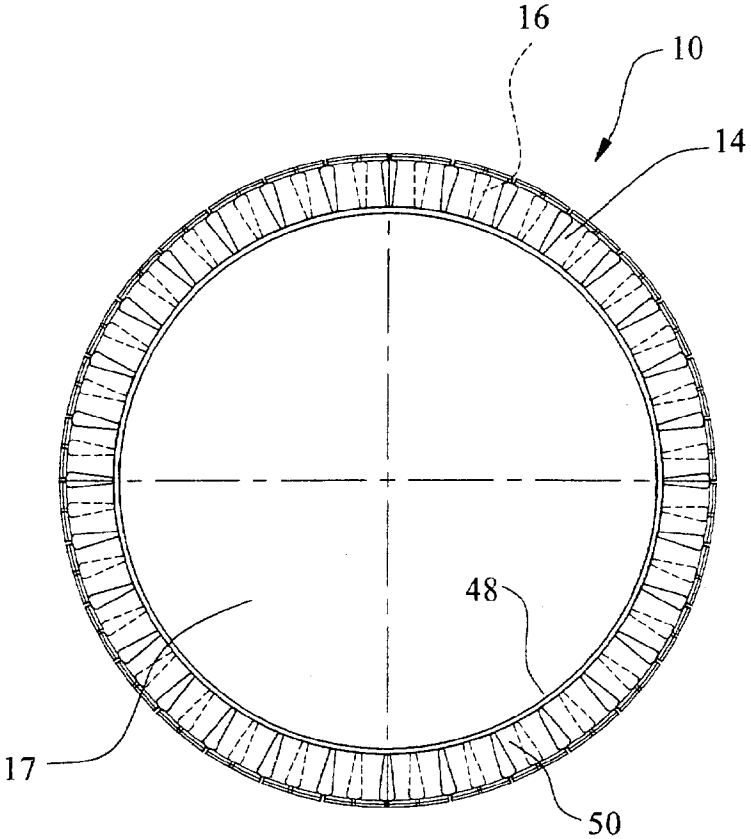
FIG. 4 is a front view of the turbine spring clip seal of FIG. 1, wherein the slots in the inner housing are misaligned with the slots in the outer housing.

Referring to FIGS. 4 and 5, when the turbine spring clip seal 10 is fully assembled, the slots 52 in the inner housing 14 may be oriented relative to the slots 24 in the outer housing 16 so that the leaves of the outer housing 16 cover the slots 52 in the inner housing 14. In other words, the slots 52 in the inner housing 14 are not aligned with the slots 24 in the outer housing 16. Thus, a fluid, such as, but not limited to, air, does not have a direct flow path through the turbine spring clip seal 10. The turbine spring clip seal 10 is suitable for use with any turbine combustor and particularly those engines whose performance is adversely effected by air leakage past spring clips. For instance, the turbine spring clip seal 10 may be particularly suited for DLN combustors.

In another embodiment, the turbine spring clip seal 10 may further include a center sealing member 66 sized and configured to fit between the inner and outer housings 14 and 16. In one embodiment, the outer and inner housings 14 and 16 have the same general configuration, and the outer housing 16 may be sized to receive the inner housing 14 in nested fashion. The center sealing member 66 may also be constructed as a ring that nests with the outer housing 16, while the inner housing 14 nests with the center sealing member 66. The center sealing member 66 may generally have a shape similar to the shape of the inner and outer housings 14 and 16, and in one embodiment, may be substantially identical to the inner and outer housings 14 and 16.

The center sealing member 66 may be flexible so that during operation of a turbine in which the seal 10 is positioned, the pressure drop between the relatively lower pressure within the center aperture 17 and the relatively higher region outside the outer housing 16, as discussed above, causes the center sealing member 66 to be drawn against the outer housing 16. In one embodiment, adequate flexibility may be achieved by forming the center sealing member 66 from a metal, such as, but not limited to, a 300 series stainless steel or a nickel based sheet material, having a thickness between about 0.004 of an inch and about 0.015 of an inch. It is evident to those of ordinary skill in the art that the thickness of the material will vary depending on the strength of the material used to form the center sealing member 66. Thus, the various thicknesses for alternative materials are not discussed.

The center sealing member 66 may also include a plurality of slots 68 positioned around the outer perimeter 46 in a configuration similar to the configuration of slots 24 and 52 in the inner and outer housings 14 and 16. In one embodiment, the slots 68 are equally spaced. The slots 68 provide increased flexibility to the perimeter 70 of the center sealing member 66 by providing a series of flexible leaves 72. One or more of the leaves 72 may include a flared end 74. In at least one embodiment, each of the leaves 72 may include a flared end 74. The width of a flared end 74 of the center sealing member 66 may be substantially equal to the width of the leaf 72 where the leaf 72 extends from a coupler section 76. In other embodiments, the width of the flared end 74 may be at least greater than the width of the leaf between the flared end 74 and the coupler section 76.

One or more leaves 72 may taper in width from the end of the leaf 72 connected to the coupler section 76 to the opposite end of the leaf 72. In particular, the leaf 72 may taper from a first dimension 78 at a first end 80 of the center sealing member 66 to a second dimension 82 at a second end 84 of the center sealing member 66. In at least one embodiment, the second dimension 82 is less than the first dimension 78. The width of the flared end 74 of the leaves 72 forming the center sealing member 66 may be greater than the second dimension 82.

Figure 8:
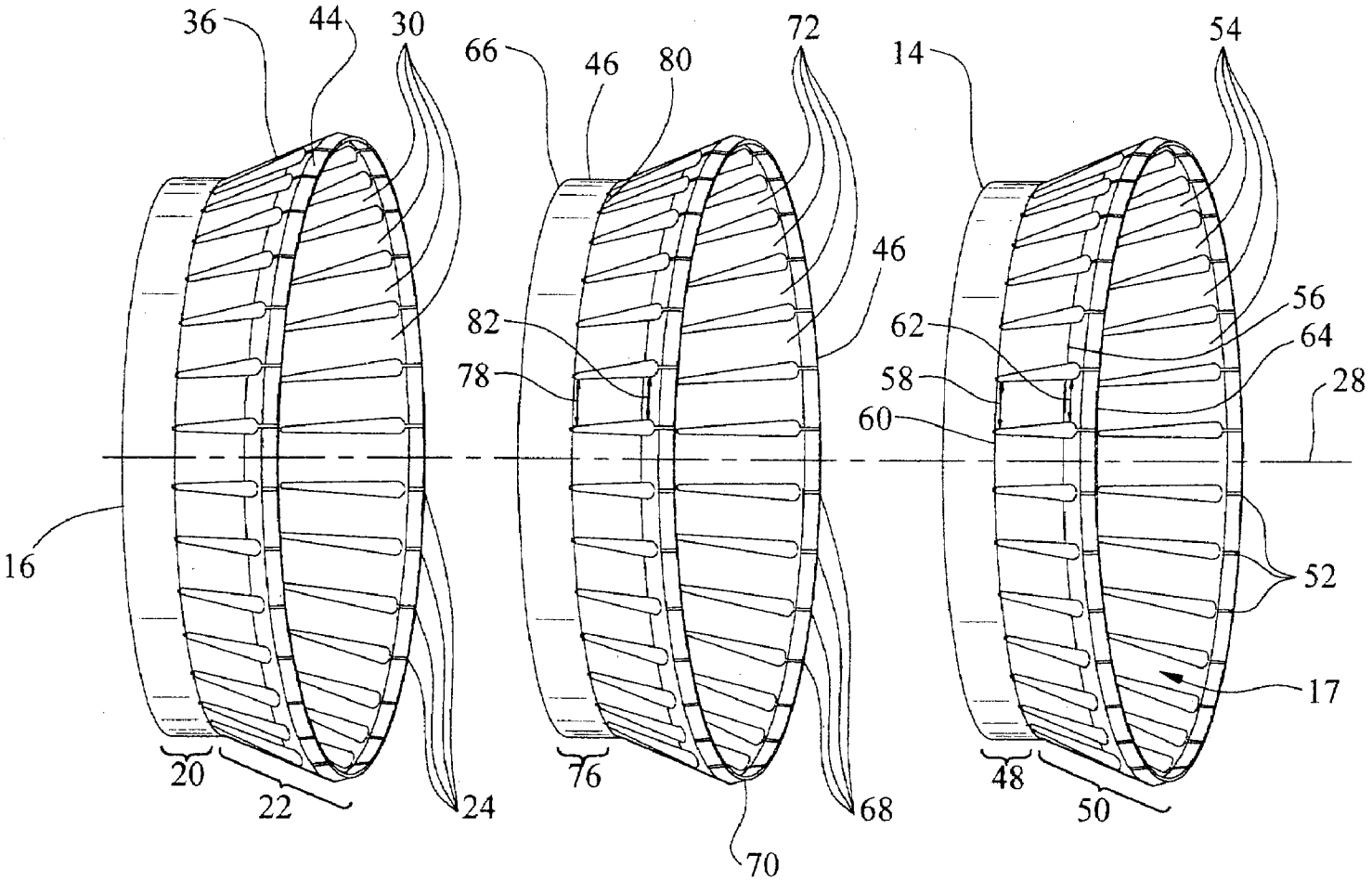
FIG. 8 is a perspective view of an alternative embodiment including an inner housing, a center sealing member, and an outer housing.

In one embodiment, as shown in FIGS. 8 and 9, the center sealing member 66 may be oriented relative to the outer housing so that the leaves 72 of the center sealing member 66 cover the slots 24 in the outer housing 16. In other words, the slots 68 in the center sealing member 66 are not aligned with the slots 24 in the outer housing 16. Thus, a fluid, such as, but not limited to, common air, does not have a direct flow path through the turbine spring clip seal 10. In an assembled turbine spring clip seal 10 of the embodiment shown in FIGS. 8 and 9, the slots 24 in the outer housing 16 are typically aligned with the slots 68 in a center sealing member 66, and the slots 52 in the inner housing 14 are misaligned with the slots 68 in the center sealing member 66 and the slots 24 of the outer housing 16. In yet another embodiment, the slots 52 in the inner housing 14 are misaligned with the slots 68 in the center sealing member 66, and the slots 24 in the outer housing 16 are misaligned with the slots 68 in the center sealing member 66. These configurations prevent at least a portion of air directed through the center aperture 17 in the turbine spring seal from leaking between the inner and outer housings 14 and 16 and, may prevent most leakage across the seal.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

What is claimed is:

1. A turbine seal, comprising:

an outer housing having an outer coupler section adapted to be attached to a first turbine component and an outer transition section extending from the outer coupler section at a first end of the outer transition section and continuing to a second end of the outer transition section, adapted to be attached to a second turbine component, wherein the outer transition section tapers from a first diameter at the first end of the outer transition section to a second diameter, which is larger than the first diameter, at the second end of the outer transition section;

the outer transition section formed from a plurality of leaves extending from the outer coupler section to the second end of the outer transition section, wherein at least one second end of at least one leaf has a flared end extending toward adjacent leaves on the outer housing and each leaf is formed by a slot on each side of the at least one leaf; and an inner housing having an inner coupler section attached to the outer coupler section of the outer housing and an inner transition section extending from the inner coupler section at a first end of the inner transition section and continuing to a second end of the inner transition section, and adapted to be attached to the outer housing during operation of the turbine; wherein the inner housing is adapted to fit inside the outer housing and the inner transition section tapers from a third diameter at the first end of the inner transition section to a fourth diameter, which is larger than the third diameter, at the second end of the inner transition section.

2. The turbine seal of claim 1, wherein all of the plurality of leaves extending from the outer coupler section to the second end of the outer transition section have flared ends extending toward adjacent leaves on the outer housing.

3. The turbine seal of claim 1, wherein the flared end on the at least one leaf has a width that is substantially equal to a width of the at least one leaf where the at least one leaf extends from the outer coupler section at the first end of the outer transition section.

4. The turbine seal of claim 1, wherein at least one of the plurality of leaves of the outer transition section tapers from a first dimension at the first end of the outer transition section to a second dimension, which is less than the first dimension, proximate to the second end of the outer transition section.

5. The turbine seal of claim 4, wherein the flared end on the at least one leaf of the outer transition section has a width that is wider than a width of the at least one leaf at the second dimension.

6. The turbine seal of claim 4, wherein the inner housing is formed from a plurality of leaves extending from the inner coupler section to the second end of the inner transition section, wherein at least one second end of at least one leaf of the inner housing has a flared end extending toward adjacent leaves on the inner housing.

7. The turbine seal of claim 6, wherein all of the plurality of leaves extending from the inner coupler section to the second end of the inner transition section have flared ends.

8. The turbine seal of claim 6, wherein the flared end of the at least one leaf of the inner housing has a width that is substantially equal to a width of the at least one leaf of the inner housing where the at least one leaf extends from the inner coupler section at the first end of the inner transition section.

9. The turbine seal of claim 6, wherein at least one of the plurality of leaves of the inner housing tapers from a first dimension at the first end of the inner transition section to a second dimension, which is less than the first dimension, proximate to the second end of the inner transition section.

10. The turbine seal of claim 9, wherein the flared end on the at least one leaf of the inner housing has a width that is wider than a width of the at least one leaf of the inner housing at the second dimension.

11. The turbine seal of claim 6, wherein the plurality of leaves of the inner housing align with the slots in the outer housing.

12. The turbine seal of claim 6, further comprising a center sealing member positioned between the inner housing and the outer housing.

13. The turbine seal of claim 6, wherein the center sealing member includes a plurality of slots forming leaves between adjacent slots.

14. The turbine seal of claim 6, wherein the center sealing member is positioned relative to the outer housing so that the leaves in the center sealing member align with the outer slots in the outer housing.

15. The turbine seal of claim 6, wherein the outer transition section of the outer housing further includes a coating on at least an outside surface of the outer housing and positioned proximate to a first edge of the outer transition section of the outer housing for contacting a second turbine component when installed for operation in a turbine.

16. The turbine seal of claim 15, wherein the coating is a spray applied coating comprising chromium carbide.

17. A turbine seal, comprising:

an outer housing having an outer coupler section adapted to be attached to a first turbine component and an outer transition section extending from the outer coupler section at a first end of the outer transition section and continuing to a second end of the outer transition section, adapted to be attached to a second turbine component, wherein the outer transition section tapers from a first diameter at the first end of the outer transition section to a second diameter, which is larger than the first diameter, at the second end of the outer transition section;

the outer transition section formed from a plurality of leaves extending from the outer coupler section to the second end of the outer transition section, wherein at least one second end of at least one leaf has a flared end extending toward adjacent leaves on the outer housing and each leaf is formed by a slot on each side of the at least one leaf;

an inner housing having an inner coupler section adapted to be attached to the outer coupler section of the outer housing and an inner transition section extending from the inner coupler section at a first end of the inner transition section and continuing to a second end of the inner transition section, attached to the outer housing during operation of the turbine; wherein the inner housing is adapted to fit inside the outer housing and the inner transition section tapers from a third diameter at the first end of the inner transition section to a fourth diameter, which is larger than the third diameter, at the second end of the inner transition section; and the inner housing formed from a plurality of leaves extending from the inner coupler section to the second end of the inner transition section, wherein at least one second end of at least one leaf has a flared end and each leaf is formed by a slot on each side of the at least one leaf.

18. The turbine seal of claim 17, wherein the flared end of the at least one leaf of the outer housing has a width that is substantially equal to a width of the at least one leaf where the at least one leaf extends from the outer coupler section at the first end of the outer transition section.

19. The turbine seal of claim 17, wherein the flared end of the at least one leaf of the inner housing has a width that is substantially equal to a width of the at least one leaf where the at least one leaf extends from the inner coupler section at the first end of the inner transition section.

20. The turbine seal of claim 17, wherein at least one of the plurality of leaves of the outer transition section tapers from a first dimension at the first end of the outer transition section to a second dimension, which is less than the first dimension, proximate to the second end of the outer transition section, and, wherein the flared end on the at least one leaf of the outer transition section has a width that is wider than a width of the at least one leaf at the second dimension.

* * * * *